United States Patent [19]

Ishikawa et al.

[11] 4,442,397

[45] Apr. 10, 1984

[54] DIRECT CURRENT POWER CIRCUIT

[75] Inventors: Hiroichi Ishikawa, Kawaguchi; Toshio Mikami, Sakado, both of Japan

[73] Assignee: Toko Kabushiki Kaisha, Tokyo, Japan

[21] Appl. No.: 342,669

[22] Filed: Jan. 25, 1982

[30] Foreign Application Priority Data

Jan. 26, 1981 [JP] Japan ..... 56-9859

[51] Int. Cl.[3] ..... G05F 1/56

[52] U.S. Cl. ..... 323/275; 323/349

[58] Field of Search ..... 323/267, 275, 276, 277, 323/278, 349; 363/20–21, 97

[56] References Cited

U.S. PATENT DOCUMENTS 3,414,803 12/1968 Glasgow et al. ..... 323/275

3,538,423 11/1970 Goleniewski ..... 323/275

4,144,484 3/1979 Minami ..... 323/349

4,321,525 3/1982 Imazeki et al. ..... 323/349 X 4,355,277 10/1982 Davis et al. ..... 363/21 X

*Primary Examiner*—Peter S. Wong

*Attorney, Agent, or Firm*—Lowe, King, Price & Becker

[57] ABSTRACT

A DC power circuit comprises a first control means which is provided between a DC power source and a pair of output terminals for controlling voltages as well as currents supplied to a load from the DC power source. An output current detector detects the output current from the DC power source, and provides a first control potential proportional to the detected current. On the other hand, an output voltage detector is coupled between the pair of output terminals for detecting the voltage applied to the load, and provides a second control potential proportional to the detected voltage. A second control means selectively assumes one of two stable states in response to external control. A third control means receives the first and second control potentials, and responds to the state of the second control means for controlling the first control means based on the received two control potentials.

13 Claims, 10 Drawing Figures

DIRECT CURRENT POWER CIRCUIT

BACKGROUND OF THE INVENTION

This invention relates to a DC (direct current) power circuit having two different output characteristics, and more particularly to a DC power circuit responsive to external control for selectively supplying a load with DC power of different characteristics.

A DC power circuit of this kind is known in the art for use as an adapter of a video tape recorder, for example. Such a DC power circuit is arranged to provide an output voltage of a preset level when used to drive the recorder, and to provide an output voltage higher than the present level when recharging a built-in battery of the recorder.

FIG. 1 is a simplified block diagram of a conventional DC power circuit. The DC power circuit of FIG. 1 generally comprises a DC power source 2, circuits 4 and 6 each including a control circuit (not shown), and a switch S. The switch S serves to selectively connect one of the circuits 4 and 6 to one output terminal 8 to obtain desired output currents as well as desired voltages through output terminals 8 and 9. FIG. 2 includes illustrations of output characteristics of the prior art of FIG. 1. Curve C1 denotes one of the two output characteristics in which the output voltage and current are controlled so as to not exceed preset limits V1 and I1, respectively, and curve C2 denotes the output characteristic in which the output voltage and current are also controlled so as to not exceed preset limits V2 and I2, respectively.

In accordance with the prior art, however, each of the circuits 4 and 6 should have a separate control circuit and hence the entire circuit becomes bulky and complicated in arrangement. Additionally, the switch S should have a high voltage rating in that it makes or breaks electrical connections between the control circuits and the output terminals, resulting in high manufacturing cost.

SUMMARY OF THE INVENTION

Accordingly, an object of the invention is to provide a DC power circuit which includes a single control circuit for selectively providing two different output characteristics.

Another object of this invention is to provide a DC power circuit which includes two switches of low voltage ratings for selectively providing two different output characteristics.

A further object of this invention is to provide a DC power circuit which can easily be constructed by simply adding a bistable, as well as two switches, to a conventional circuit with only sight modification thereto.

In order to achieve the object, the present invention contemplates to selectively provide one of two different output characteristics through the use of a single control circuit. The control circuit is arranged in power lines from a DC power source to the output terminals of the circuit. An output current detector detects the current from the control circuit and applies a voltage, proportional to the detected current, to a first voltage divider. The first voltage divider is responsive to the switching state of a first switch to change the output voltage thereof. The first switch is controlled by a bistable circuit. The output from the first voltage divider is fed to a first error amplifier which generates an error signal is generated based on the difference between a first reference voltage and the output applied thereto from the first voltage divider. On the other hand, an output voltage detector derives a signal proportional to the voltage developed across a load connected to the DC power circuit and supplies the signal to a second voltage divider. The second voltage divider is responsive to the switching state of a second switch to change its output voltage. The second switch is also controlled by the bistable circuit in a manner similar to the above. The output from the second voltage divider is then fed to a second error amplifier which generates an error signal based on the difference between a second reference voltage and the output applied thereto from the second voltage divider. The control circuit is responsive to the outputs from the two error amplifiers for controlling DC output power to be supplied to the load.

BRIEF DESCRIPTION OF THE DRAWINGS

Other objects, advantages and the features of the present invention will become apparent from the following detailed description which is given by way of example with reference to the drawings wherein like parts and portions are designated by like reference numerals and characters, and wherein.

DETAILED DESCRIPTION

Figure 1:
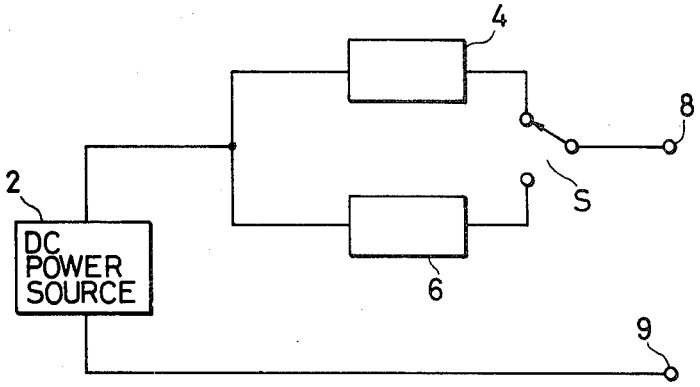
FIG. 1 (PRIOR ART)
FIG. 1 is a simplified block diagram of a conventional DC power circuit.
Figure 2:
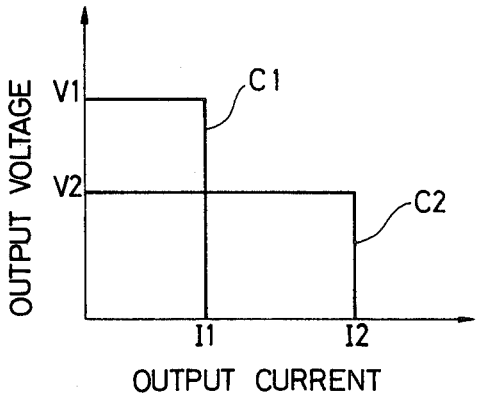
FIG. 2 (PRIOR ART)
FIG. 2 includes illustrations of output characteristics of the prior art of FIG. 1.
Figure 3:
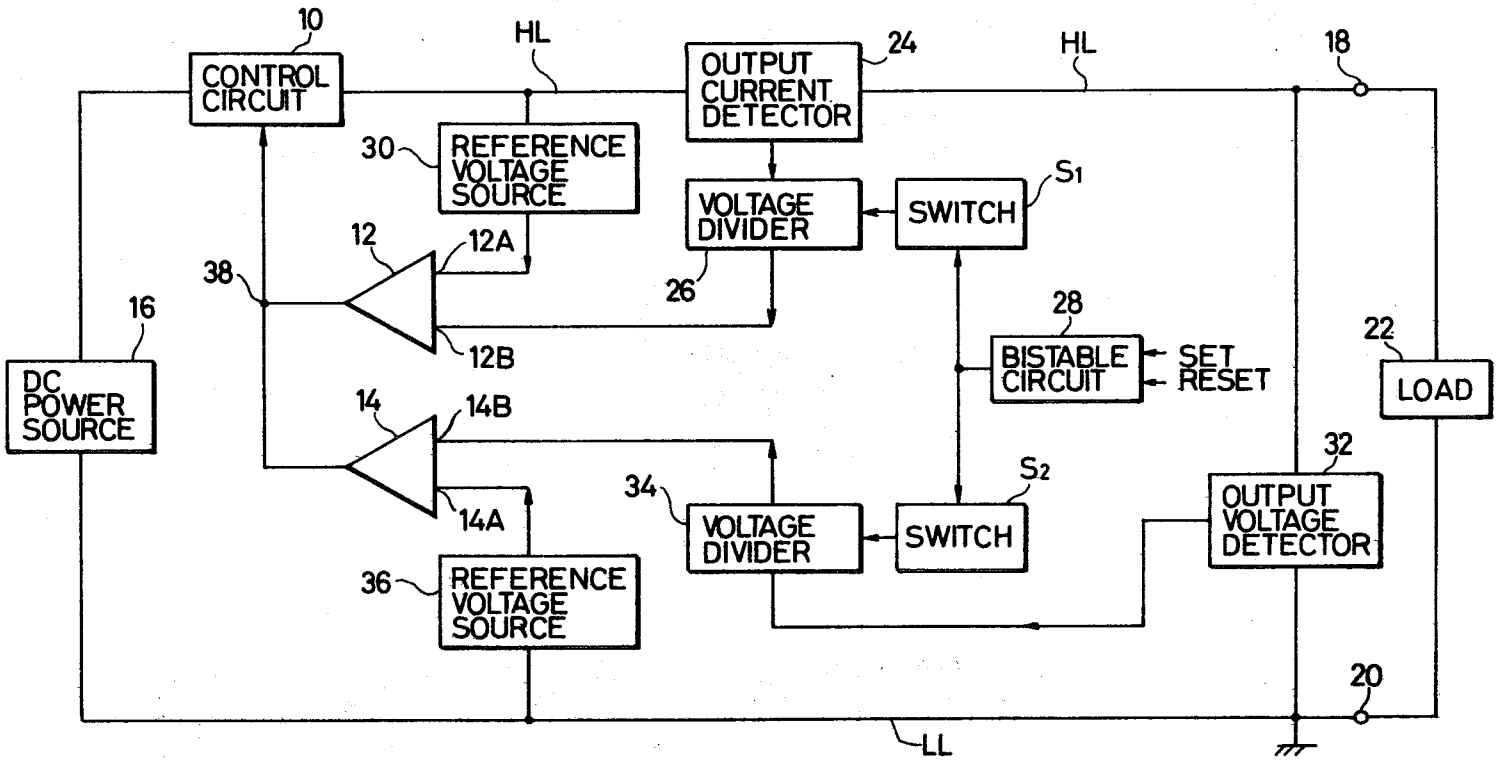
FIG. 3 is a block diagram illustrating one preferred embodiment of the invention.

Referring now to FIG. 3, there is shown a first embodiment of a DC power circuit of the invention. The DC power circuit of FIG. 3 comprises a control circuit 10 responsive to the outputs from error amplifiers 12 and 14 to control output currents and voltages supplied by a DC power source 16 to load 22, so the load is supplied with predetermined currents and voltages. The load 22 is coupled between output terminals 18 and 20. An output current detector 24, arranged in a high voltage line HL between the control circuit 10 and the terminal 18, detects the output current from the control circuit 10. The output current detected by the detector 24 is applied to a voltage divider 26. The divider 26 is responsive to the switching state of a switch S1 to selectively apply either one of a high or a low voltage to one input terminal 12B of the error amplifier 12. The switch S1 is controlled by an output signal from a bistable circuit 28. The error amplifier 12 is supplied at an other input terminal 12A with a reference voltage from a reference voltage source 30, and generates an output proportional to the difference between the two voltages received at the terminals 12A and 12B, respectively. An output voltage detector 32, coupled in parallel, through the output terminals 18 and 20, with the load 22, serves to detect an output voltage applied to the load 22. The voltage thus detected by the detector 32 is then fed to a voltage divider 34. The divider 34 is responsive to the switching state of a switch S2 and selectively applies one of a high and a low voltage to one input terminal 14B of the error amplifier 14. In a manner similar to the above, the switch S2 is controlled by the output signal from the bistable circuit 28. The error amplifier 14 is supplied at the other input terminal 14A with a reference voltage from a reference voltage source 36, and generates an output proportional to the difference between two voltages received at the terminals 14A and 14B, respectively. The outputs of the error amplifiers 12, 14 are wired-OR connected at a junction 38 which is coupled to the control circuit 10.

The bistable circuit 28, when set by a suitable means or an operator, applies, for example, a high voltage signal to the switches S1 and S2. Each of the switches S1 and S2 responds to the applied high voltage signal, causing the voltage divider associated therewith to generate a low voltage signal. Low voltage signals from the dividers 26 and 34 are applied to the error amplifiers 12 and 14, respectively. The error amplifier 12 compares the reference voltage with the low voltage signal from the voltage divider 26, to generate a high voltage signal therefrom. In a similar manner, the error amplifier 14 compares the reference voltage with the low voltage signal from the voltage divider 34, to generate a high voltage signal therefrom. The outputs of the error amplifilers 12 and 14 are ORed at the junction 38, and the result of the logical operation is applied to the control circuit 10. The control circuit 10 responds to the control signal based on the outputs from the amplifiers 12 and 14, to control the output currents and voltages to be supplied to the load 22.

On the other hand, the bistable circuit 28, when reset, applies a low voltage signal to the switches S1 and S2. In response to this low voltage signal, the switches S1 and S2 change states to allow the voltage dividers 26 and 34 to apply high voltage signals to the error amplifiers 12 and 14, respectively. Each of the error amplifiers 12 and 14 compares the reference voltage with the applied high voltage signal, to generate a low voltage signal. Similarly, the low level signals from the amplifiers 12 and 14 are ORed at the junction 38, and the result of the logical operation is applied to the control circuit 10. The circuit 10 responds to the signal from the junction 38 to control the output characteristics of the FIG. 3 circuit in a predetermined manner. Thus, the DC power circuit shown in FIG. 3 is provided with a single control circuit and can supply one of two output power characteristics in response to the selected state of the bistable circuit 28.

Hereinafter a detailed description of given portions of the circuit shown in FIG. 3 are given in conjunction with FIGS. 4 to 6.

Figure 4A:
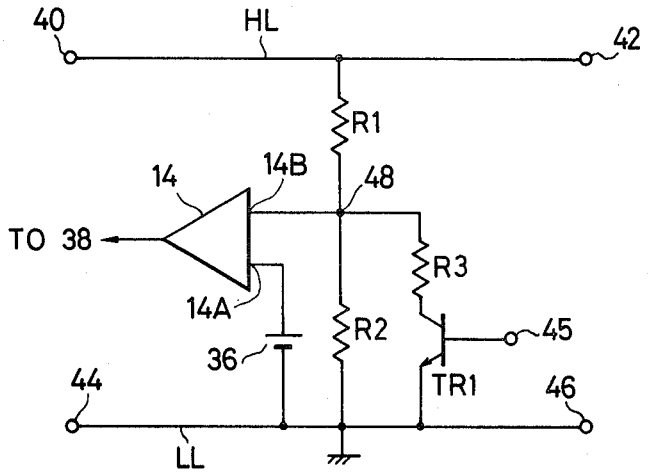
FIGS. 4A and 4B are circuit diagrams of details of one portion of FIG. 3.

FIG. 4A is a detailed circuit diagram of the output voltage detector 32, the voltage divider 34, together with the reference voltage source 36 as well as the switch S2. In this Figure, the terminals 40 and 42 are coupled to the output current detector 24 and the output terminal 18, respectively, and the terminals 44 and 46 are coupled to the power source 16 and output terminal 20, respectively. Resistors R1 and R2 are arranged in series between the high and low power lines HL and LL, and the junction 48 between the resistors R1 and R2 is connected to the input terminal 14B of the error amplifier 14. The reference voltage source 36 is provided between the input terminal 14A and the low power line LL. Resistor R3 is coupled in series with the main current path of the transistor TR1, and this series circuit is arranged in parallel with the resistor R2. The transistor TR1 has a base connected through a terminal 45 to be responsive to the output of the bistable circuit 28. The resistors R1, R2 and R3 form the voltage detector 32 as well as the voltage divider 34 (see FIG. 3) and the transistor TR1 corresponds to the switch S2.

In operation, the transistor TR1 is rendered conductive or turned ON, when the high voltage set indicating signal from the bistable circuit 28 is coupled to the base thereof, thereby allowing a portion of the current flowing through the resistor R1 to bypass the resistor R2. This causes a reduction of the voltage at the junction 48. The error amplifier 14 compares the voltage at the junction 48 with the reference voltage from the reference voltage source 36. On the other hand, when the bistable circuit 28 applies the low voltage reset indicating signal to the base of the transistor TR1, the transistor is rendered non-conductive or turned OFF and increases the voltage at the junction 48. Thus, the error amplifier 14 in turn generates an higher output than when bistable circuit 28 is set. Thus, the error amplifier 14 respectively generates the low and high voltages in response to the ON and OFF states of the transistor TR1, namely in response to the set and reset states of the bistable circuit 28.

Figure 4B:
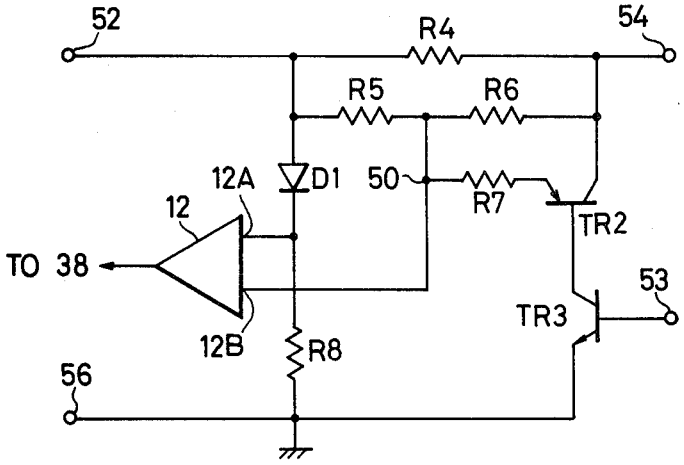

FIG. 4B is a circuit diagram in detail of another example of an output current detector 24, voltage divider 26, switch S1 and reference voltage source 30, together with error amplifier 12. In FIG. 4B a resistor R4 corresponds to the output current detector 24. Resistors R5, R6 and R7 form the voltage divider 26, transistors TR2 and TR3 form the switch S1. A junction 50 of the resistors R5, R6 and R7 is connected to the input terminal 12B of the error amplifier 12. The base of transistor TR3 is connected through a terminal 53 to the bistable circuit 28, responding to the control signal therefrom to control the ON and OFF states of the transistor TR3. Terminals 52 and 54 are coupled to the control circuit 10 and output terminal 18, respectively, and a terminal 56 is coupled to the power source 16. The ON and OFF states of the transistor TR2 make or break the electrical connection between the resistor R7 and the resistor R6. A diode D1 and a resistor R8 are connected between the lines HL and LL, and the junction thereof is coupled to the input terminal 12A of the error amplifier 12. The diode D1 and the resistor R8 form the reference voltage source 30, and the constant voltage drop across the diode D1 is used as the reference voltage applied to the input terminal 12A of the error amplifier 12.

In operation, when the bistable circuit 28 applies a high voltage set indicating signal to the base of the transistor TR3, the transistor is rendered conductive thereby changing the transistor TR2 from an OFF state to an ON state thus reducing the voltage at the junction 50. On the other hand, when the bistable circuit 28 applies a low voltage rest indicating signal to the base of the transistor TR3, the transistor is in turn rendered non-conductive to also cause the transistor TR2 to be non-conductive. Therefore, the voltage at the junction 50 increases as against the above case. The error amplifier 12 is responsive to the two different voltages at the junction 50, selectively producing high and low voltage signals, as referred to in the above.

Figure 5A:
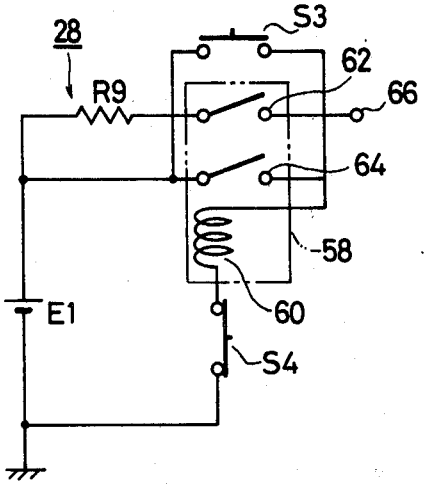
FIGS. 5A through 5C are circuit diagrams of details of another portion of FIG. 3.
Figure 5B:
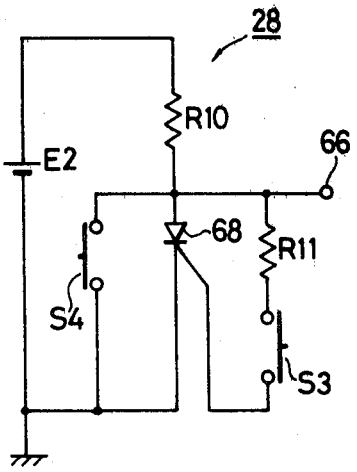
Figure 5C:
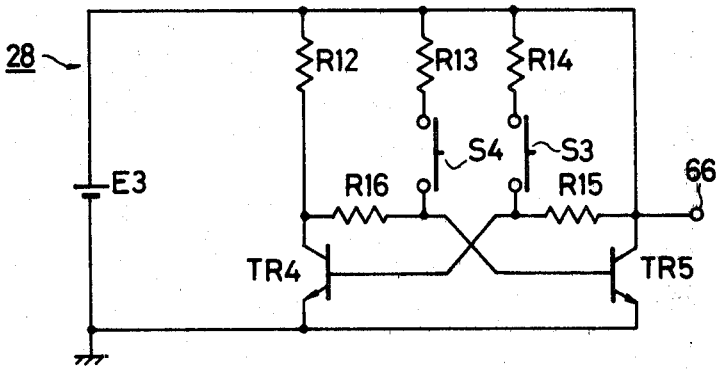

Each of FIGS. 5A to 5C is a circuit diagram of a detail of a different embodiment of the bistable circuit 28.

The bistable circuit 28 of FIG. 5A comprises a relay 58, a normally open set switch S3, a normally closed reset switch S4, and a DC power source E1. The relay 58 is provided with a relay coil 60, two contacts 62 and 64. The contact 62 is coupled to the output terminal 66 which is in turn connected to the bases of the transistors TR1 and TR3 (see FIGS. 4A and 4B). Closing of the switch S3 energizes the coil 60, to cause closing of contacts 62 and 64. The closing of the contact 64 continues energization of the coil 60, so that the contact 62 is maintained closed regardless of whether switch S3 is open or closed. Thus, a high voltage is continuously obtained from the output terminal 66 until the reset switch S4 is opened. In a manner similar to the above, the opening of the switch S4 causes de-energization of the coil 60 with the result that the contacts 62 and 64 open, whereby the low voltage appears at the output terminal 66. A resistor R9 is provided for permitting easy selection of the circuit characteristics.

The bistable circuit 28 shown in FIG. 5B generally comprises a thyristor 68, a normally open set switch S3, a normally open reset switch S4, and a DC power source E2. When the switch S3 is closed, the thyristor 68 is turned ON and remains on even if the switch S3 is re-opened, whereby a low voltage appears at the output terminal 66. Whereas, the thyristor 68 is turned OFF upon closing of the switch S4 in that the thyristor anode current is reduced thereby. The OFF state of the thyristor 68 is maintained until the set switch S3 is again closed. Thus, a high voltage is generated at the output terminal 66. In FIG. 5B resistors R10 and R11 are provided for ready selection of circuit parameters.

The bistable circuit 28 of FIG. 5C comprises normally open set and reset switches S3 and S4, two transistors TR4 and TR5, a DC power source E3, and resistors R12 to R16 for ready selection of circuit parameters. In order to obtain a high voltage signal at the output terminal 66, the set switch S3 is closed to turn ON and OFF the respective transistors TR4 and TR5. These states of the transistors TR4 and TR5 are maintained after opening of the set switch S3. In a similar manner, when the reset switch S4 is closed, the transistors TR4 and TR5 turn OFF and ON, respectively, thereby generating a low voltage signal at the terminal 66. This state continues until the set switch S3 is again closed.

Figure 6:
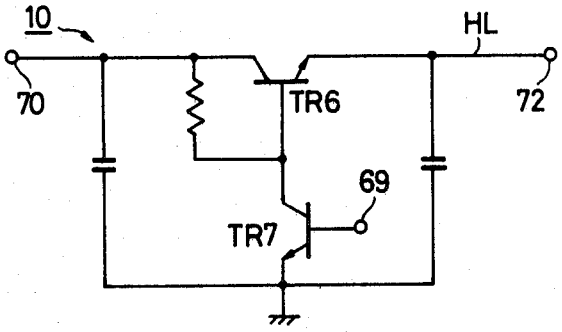
FIG. 6 is a circuit diagram of a detail of still another portion of FIG. 3.

FIG. 6 is a circuit diagram of a simplified example of the control circuit 10 of a series control type. The circuit of FIG. 6 generally comprises transistors TR6 and TR7. The transistor TR6 has a main current path provided in the high voltage line HL. The control signal from the junction 38 of FIG. 3 is applied to the base of TR7 through a terminal 69. When the base current of the transistor TR7 flows in response to the applied control signal, a portion of the base current of the transistor TR6 flows through the transistor TR7, so that the conductive state of the transistor changes, thereby controlling the ouput current as well as output voltage of the control circuit 10 of FIG. 6.

Alternatively, a switching type of control circuit is also applicable to the control circuit 10, although the detailed description thereof is omitted.

Figure 7:
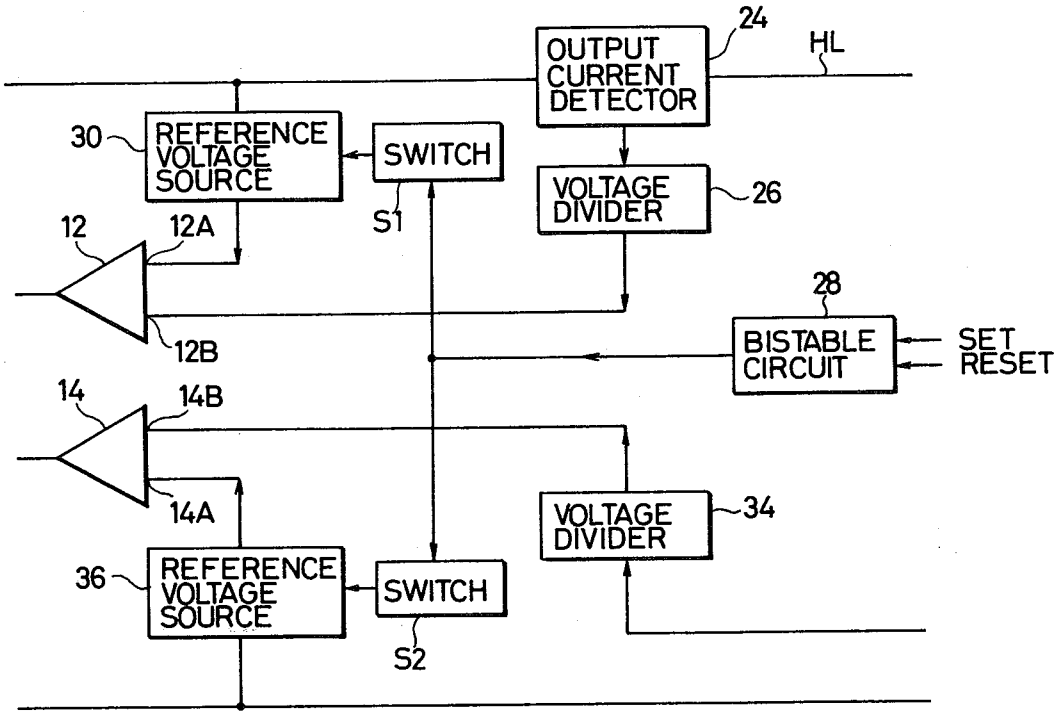
FIG. 7 is a block diagram of another preferred embodiment of the invention.

FIG. 7 is a circuit diagram of a modification of the first embodiment of FIG. 3 wherein is illustrated the modified portion together with relevant blocks. The difference between FIGS. 3 and 7 is that in the latter the switches S1 and S2 are not coupled to the voltage dividers 26 and 34, but to the reference voltage sources 30 and 36, respectively. This connection is for controlling the reference voltages to be generated therefrom. The other portions are the same as those of FIG. 3, so that further discussion is omitted for brevity.

As understood from the above, since only one control circuit is required to provide two different output characteristics, the DC power circuit according to the invention features simplicity in circuit configuration and low manufacturing cost, as compared with the prior art. Furthermore, the switches S1 and S2 of the invention are not used for controlling large currents as in the prior art. Still furthermore, the DC power circuit of the invention can be constructed with ease by simply adding the bistable circuit 28, as well as the switches S1 and S2 to a conventional circuit with only slight modification thereto.

The embodiments shown above are merely by way of example and various modifications and alterations will be apparent to those skilled in the art without departing from the scope of the invention which is only limited to the appended claims.

What is claimed is:

1. A DC power circuit having two different output characteristics, comprising:

a DC power source;

a pair of output terminals;

a first control means provided between said DC power source and said pair of output terminals for controlling the voltages as well as currents supplied to a load from said DC power source;

an output current detector for detecting the output current from said first control means for providing a first control potential proportional to the detected current;

an output voltage detector which is coupled between said pair of output terminals for detecting voltage applied to the load and which provides a second control potential proportional to the detected voltage;

a second control means for selectively assuming one of two stable states in response to an external control;

and a third control means which is connected to said output current detector and said output voltage detector for receiving said first and said second control potentials therefrom, respectively, and which is also connected to said first and said second control means and which controls circuit parameters in response to the state of said second control means for controlling said first control means based on the received two control potentials.

2. A DC power circuit according to claim 1, wherein said third control means includes, a first voltage divider coupled to said output current detector for receiving said first control potential therefrom, a second voltage divider coupled to said output voltage detector for receiving said second control potential therefrom, a first error amplifier for receiving and comparing the output of said first voltage divider with a first reference voltage and selectively providing one of two voltage signals, and a second error amplifier for receiving and comparing the output of said second voltage divider with a second reference voltage and selectively providing one of two voltage signals, and wherein said second control means includes, a bistable circuit for selectively generating one of two different signals in response to external control, a first switch which is connected to said first voltage divider and which is responsive to the output of said bistable circuit and which changes its switching state for controlling the output of said first voltage divider, a second switch which is connected to said second voltage divider and which is responsive to the output of said bistable circuit and which changes its switching state for controlling the output of said second voltage divider, said first control means being responsive to the outputs of said first and said second error amplifiers for controlling the voltages as well as currents supplied to the load.

3. A DC power circuit according to claim 1, wherein said third control means includes, a first voltage divider coupled to said output current detector for receiving said first control potential therefrom, a second voltage divider coupled to said output voltage detector for receiving said second control potential therefrom, a first error amplifier for receiving and comparing the output of said first voltage divider with a first reference voltage and selectively providing one of two voltage signals, and a second error amplifier for receiving and comparing the output of said second voltage divider with a second reference voltage and selectively providing one of two voltage signals, and wherein said second control means includes, a bistable circuit for selectively generating one of two different signals in response to external control, a first switch which is responsive to the output of said bistable circuit and which changes its switching state for controlling said first reference voltage, a second switch which is responsive to the output of said bistable circuit and which changes its switching state for controlling said second reference voltage, said first control means being responsive to the output of said first and second error amplifiers for controlling the voltages as well as currents supplied to the load.

4. A DC power circuit having two different output characteristics, comprising:

a DC power source;

a pair of output terminals;

a control circuit provided between said DC power source and said pair of output terminals;

an output current detector for detecting the output current from said control circuit;

a first voltage divider coupled to said output current detector and receiving a first control potential proportional to the detected current therefrom;

an output voltage detector coupled between said pair of output terminals;

a second voltage divider coupled to said output voltage detector and receiving a second control potential proportional to the detected voltage therefrom;

a bistable circuit for selectively generating one of two different voltage signals in response to an external control;

a first switch which is coupled to said first voltage divider and which is responsive to the output of said bistable circuit for controlling the output of said first voltage divider;

a second switch which is coupled to said second voltage divider and which is responsive to the output of said bistable circuit for controlling the output of said second voltage divider;

a first error amplifier for receiving and comparing said first control potential with a first reference voltage, and selectively providing one of two voltage signals; and a second error amplifier for receiving and comparing said second control potential with a second reference voltage, and selectively providing one of two voltage signals, wherein said control circuit is responsive to the outputs of said first and second error amplifiers for controlling the voltages as well as currents supplied from said DC power source to a load connected to said pair of output terminals.

5. A DC power circuit having two different output characteristics, comprising:

a DC power source;

a pair of output terminals;

a control circuit provided between said DC power source and said pair of output terminals;

an output current detector for detecting the output current from said control circuit;

a first voltage divider coupled to said output current detector and receiving a first control potential proportional to the detected current therefrom;

an output voltage detector coupled between said pair of output terminals;

a second voltage divider coupled to said output voltage detector and receiving a second control potential proportional to the detected voltage therefrom;

a bistable circuit selectively generating one of two different voltage signals in response to an external control;

a first reference voltage source for generating a first reference voltage;

a second reference voltage source for generating a second reference voltage;

a first switch which is coupled to said first reference voltage source and which is responsive to the output of said bistable circuit for changing the first reference voltage;

a second switch which is coupled to said second reference voltage source and which is responsive to the output of said bistable circuit for changing the second reference voltage;

a first error amplifier for receiving and comparing the output of said first voltage divider with the first reference voltage, and selectively providing one of two voltage signals; and a second error amplifier for receiving and comparing the output of said second voltage divider with the second reference voltage, and selectively providing one of two voltage signals, wherein said control circuit is responsive to the outputs of said first and second error amplifiers to control the voltages as well as currents supplied from said DC power source to a load connected to said pair of output terminals.

6. A power supply circuit responsive to a power source for supplying load terminals with an output having one of N maximum output voltages each associated with a maximum output current, the circuit being controlled by N inputs one for each of the N maximum output voltages, the circuit responding to the N inputs to provide different relationships between maximum current and voltage so that for each different one of the N inputs there is a different maximum output voltage and current, the circuit comprising means for comparing the voltage and current supplied by the source to the load terminals with reference values therefor to derive first and second error signals having magnitudes respectively indicative of the magnitude of the deviation between the supplied voltage and current and the reference values therefor, means responsive to the N inputs for controlling the relative magnitudes between proportionality constants for the compared magnitudes of the reference values and the supplied voltage and current to maintain the relationship between the maximum voltage and maximum current for each of the N inputs and a variable impedance current and voltage regulator connected between the power source and the load terminals and responsive to the first and second error signals to control the load voltage and current.

7. The circuit of claim 6 wherein the means for comparing includes means for deriving first and second signals respectively proportional to the voltage and current supplied to the load, first and second voltage dividers respectively responsive to the first and second signals, the relative magnitude controlling means including means for adjusting the voltage division factors of both of the first and second voltage dividers in response to a single one of each of the N inputs, the first and second voltage dividers having output taps for supplying signals indicative of the supplied voltage and current to the means for comparing.

8. The circuit of claim 7 wherein the means for comparing includes first and second amplifiers for deriving the first and second error signals, the first and second amplifiers being respectively responsive to first and second reference voltages and signals at the taps of the first and second voltage dividers.

9. The circuit of claim 8 wherein the first voltage divider is connected across the load terminals and includes first and second fixed resistors between which one of the taps is connected, a third fixed resistor, and first switch means for connecting the third resistor in shunt with the second resistor in response to derivation of one of the N inputs, the means for deriving the third signal including an impedance in series between the source and load, the second voltage divider being connected to be responsive to a voltage developed across the series impedance, the second voltage divider including fourth and fifth fixed resistors between which the other tap is connected, a sixth fixed resistor, and second switch means for connecting the sixth resistor in shunt with the fifth resistor in response to derivation of the one of the N inputs.

10. The circuit of claim 7 wherein N=2 and further including a bistable circuit responsive to the inputs, the bistable circuit deriving a single bilevel output, the bilevel output being applied in parallel to the first and second voltage dividers to control the voltage division factors thereof simultaneously.

11. The circuit of claim 6 wherein the means for comparing includes means for deriving first and second signals respectively proportional to the voltage and current supplied to the load, first and second reference voltage sources, the relative magnitude controlling means including means for adjusting the magnitudes of the reference voltage source in response to a single one of each of the N inputs, the means for comparing being responsive to the adjusted reference voltages and the first and second signals.

12. The circuit of claim 7 wherein the means for comparing includes first and second amplifiers for deriving the first and second error signals, the first and second amplifiers being respectively responsive to the adjusted reference voltages and the first and second signals.

13. The circuit of claim 12 wherein N=2 and further including a bistable circuit responsive to the inputs, the bistable circuit deriving a single bilevel output, the bilevel output being applied in parallel to the first and second reference voltage to control the reference voltages simultaneously.

* * * * *